United States Patent [19]

Nativi et al.

[11] Patent Number: 5,051,654

[45] Date of Patent: Sep. 24, 1991

[54] ELECTROLUMINESCENT LAMP AND METHOD OF MANUFACTURE

[75] Inventors: Larry A. Nativi, Rocky Hill, Conn.; Robert H. Marion, Lebanon; Tahsin A. Ashour, Amherst, both of N.H.

[73] Assignee: Loctite Luminescent Systems, Inc., Lebanon, N.H.

[21] Appl. No.: 544,761

[22] Filed: Jun. 27, 1990

Related U.S. Application Data

[63] Continuation of Ser. No. 285,796, Dec. 16, 1988, abandoned.

[51] Int. Cl.[5] ..... H05B 33/04

[52] U.S. Cl. ..... 313/506; 313/509; 313/512; 427/66

[58] Field of Search ..... 313/506, 509, 512; 427/66

[56] References Cited

U.S. PATENT DOCUMENTS

| | | | |
|---|---|---|---|
| 4,066,925 | 1/1978 | Dickson | 313/503 |
| 4,104,555 | 8/1978 | Fleming | 313/512 |
| 4,593,228 | 6/1986 | Albrechtson et al. | 313/512 |
| 4,687,968 | 8/1987 | Frayer | 313/509 |
| 4,767,966 | 8/1988 | Simopoulos et al. | 313/509 |

FOREIGN PATENT DOCUMENTS 2049274 12/1980 United Kingdom .

*Primary Examiner*—Donald J. Yusko
*Assistant Examiner*—Michael Horabik
*Attorney, Agent, or Firm*—Edward K. Welch, II; Eugene F. Miller

[57] ABSTRACT

An improved electroluminescent lamp is described comprising a desiccant layer comprising a formed-in-place patternable hygroscopic film layer.

17 Claims, 2 Drawing Sheets

ELECTROLUMINESCENT LAMP AND METHOD OF MANUFACTURE

This is a continuation of copending application Ser. No. 07/285,796 filed on Dec. 16, 1988 now abandoned.

BACKGROUND OF THE INVENTION

This invention relates to a method of manufacturing visible display devices from electroluminescent phosphors and more particularly to a method of making an electroluminescent light source in the form of a thin, flexible, multi-layered assembly, and to a lamp as produced.

An electroluminescent lamp is basically composed of a layer of electroluminescent phosphor material typically of a metal activated zinc sulfide fixed in place by a polymer binder between two conductive layers, one of which is transparent. When an alternating electric field is applied across the conductors, the phosphors are excited and emit photons with almost all of the radiated energy lying within the visible light spectrum. The emission spectrum and wavelength generated by the phosphors is controlled by the activator element such as copper or manganese.

Electroluminescent phosphors and the polymer binders used are inherently hygroscopic and sensitive to moisture. When exposed to high humidity, the luminescent capability of the phosphor particles is diminished, and performance deteriorates. The sensitivity of the phosphor particles to moisture is so strong that exposure even to conditions of low humidity may adversely affect performance and decrease the light output capacity and useful life of the lamp in which the phosphors are incorporated. To effectively reduce the exposure of the electroluminescent phosphors to moisture, an internal desiccant layer may be incorporated in the lamp.

One method of fabricating an electroluminescent lamp is currently employed starting with a conductive non-transparent substrate of, for example, a sheet of aluminum foil upon which is coated an insulating layer of high dielectric constant material such as barium titanate. Then, an electroluminescent phosphor in a polymer binder is deposited over the dielectric layer and oven dried. A transparent conductive coating formed from, for example, indium oxide and/or indium tin oxide is then deposited over the phosphor layer to form the front electrode. Alternatively, the front electrode may be formed from indium-tin-oxide sputtered Mylar film. A busbar having a conductivity greater than the conductivity of the transparent conductive coating is formed adjacent the periphery of the transparent conductive coating, and a thin nylon preformed film is then applied over the busbar and front electrode. The nylon film or other suitable desiccant film acts as an internal desiccant whose purpose is to collect and hold any small traces of moisture left over from the manufacturing process and to scavenge and retain any moisture which may infiltrate the lamp area. Thereafter, the nylon desiccant film is pulled up to position and attach the front lead, and a second lead is attached to the aluminum foil conductive substrate. Alternatively, the front lead may be positioned before applying the desiccant film, but this may present staining problems since the desiccant film also protects the lamp during processing and handling to prevent staining due, for example, to skin oils from the person handling the lamp. Therefore, the preferable method is to apply the desiccant film and peel it back to position the lead on the busbar.

The entire assembly excluding a portion of the connecting leads is then sandwiched between two moisture barrier films such as a polychlorotrifluoroethylene (PCTFE) film which is commercially available from Allied Chemical Co. under the trade name ACLAR ®, or a polyester film, both of which are heat laminated to the assembly and to each other around the perimeter of the lamp. As will be appreciated, the current manufacturing procedure is labor intensive and time consuming, and has inherent quality control problems resulting in a considerable number of unusable lamps. Moreover, in current manufacture lifting the nylon desiccator film in order to position and attach the front lead may break the busbar, and/or permit ingress of moisture and/or contaminants which may result in premature lamp failure in the field.

Moreover, the use of nylon desiccant films adds other manufacturing difficulties. These include the necessary precutting which is usually done off-line, and static charge build-up which inherently occurs in the handling of nylon film. This static charge attracts dust, often causing unacceptable lamps. Other problems involve hand tacking and lead attachment when using nylon film.

BRIEF SUMMARY OF THE INVENTION

The present invention overcomes the aforesaid and other prior art problems by using a patternable formed-in-place desiccant polymer film in place of a preformed desiccant film of nylon or other suitable desiccator materials. The patternable formed-in-place desiccant polymer material is applied directly to the assembly following attachment of the busbars, leaving the lead traces exposed, and is cured-in-place by a method appropriate to the particular material selected, for example, thermal curing, air drying, or exposure to ultra-violet or other radiation. The resulting cured-in-place polymeric film material completely protects the underlying layers. Besides applying a layer of the desiccant polymer material to the light-emitting side of the lamp, a similar layer may be applied to the back of the lamp. Thereafter, the resulting assembly can be, and is preferably sealed between two moisture barrier members such as ACLAR ® PCTFE film.

DETAILED DESCRIPTION OF THE INVENTION

For a fuller understanding of the invention reference should be made to the following specification taken in connection with the drawings in which.

Figure 1:
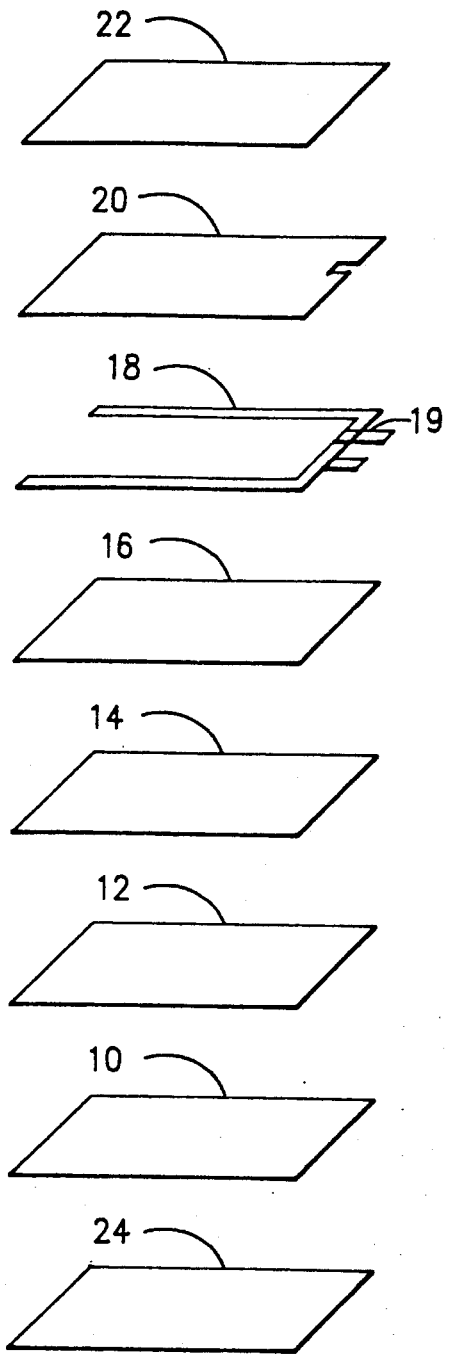
FIG. 1 shows an exploded diagrammatic schematic view of an electroluminescent lamp made in accordance with the present invention.

Referring now to FIG. 1 of the drawings, the construction and process of the present invention involves the following steps. An aluminum 24 oz. foil sheet 10 is first coated with a barium titanate paint layer 12, which is then oven dried. Thereafter, a phosphor paint layer 14 is applied over layer 12 and this is oven dried. An indium tin oxide electrode 16 is then silkscreened on, and this is oven dried. Next silver busbars 18 are silkscreened onto electrode 16 and oven dried. The resulting assembly is then coated with a patternable curable desiccant polymer coating 20 which is silkscreened over the busbars 18 (leaving an area for lead attachment exposed) and over the indium tin oxide electrode 16, and the coating is cured-in-place to form a desiccant film coating. The patternable curable desiccant polymer coating may comprise one or a mixture of screenable materials which form on curing a film. The term curing as used herein includes, but is not limited to, air drying, oven drying, heat curing, solvent evaporation, photocuring, and radiation curing. The term patternable as used herein refers to materials which are capable of being applied using any one of a number of techniques, including but not limited to printing, coating, spraying, depositing, painting, silkscreening, or otherwise forming in place. While there are a large number of materials which can be used as the patternable curable desiccant polymer coating material in accordance with the present invention, the preferred materials comprise those which (1) are sufficiently flowable in the uncured state so as to be capable of being patternable, printable, formed-in-place, or applied using selective deposition techniques such as silkscreening, in order to cure to films; (2) have good bonding characteristics to the underlying surfaces; (3) are thermally stable at the expected processing and operating temperatures of the lamp; and (4) have a relatively low but sufficient solubility in water to scavenge and retain any moisture left over from the manufacturing process or which may infiltrate the lamp during its design life. Generally, said curable coating material comprises a film forming polymer solution, a film forming polymer emulsion or a film forming polymer composition. Among suitable materials are mentioned soluble nylon such as Elvamide® (available from E. I. DuPont de Nemours Co.), cellulose acetate, polyvinyl alcohol (PVA), and polyethyloxazoline (PEOX®, available from Dow Chemical Co.) resins. Additionally, certain thermal setting polymers and resins can be used to achieve the advantages of the present invention. Yet another and preferred class of materials useful in the present invention comprise UV or other radiation curable materials. Amongst suitable and preferred UV curable materials are mentioned Lite-Tak TM 375 UV curing adhesive and Lite-Tak TM 376 UV curing adhesive, both available from Loctite Corporation. The manufacturer describes these materials as comprising a mixture of polyurethane acrylate resins, a cyclic amide, acrylate or ethoxyethocyethyl acrylate, and a photoinitiator.

The coated assembly then is subjected to appropriate conditions to cure the polymer material. Thereafter, the leads 19 are attached and the resulting assembly is sealed between two layers (22 and 24) of moisture barrier sheet materials such as ACLAR® film available from Allied Chemical Co., which may be laminated to the opposite faces of the assembly using an adhesive or hot laminating technique whereby to form an electroluminescent lamp.

The features and advantages of the present invention are more fully shown with respect to the following working example which describes a preferred embodiment of the invention.

WORKING EXAMPLE

In a preferred embodiment of the invention the basic lamp structure is fabricated in known manner by applying a suspension of barium titanate in a heat curable resin and drying onto an aluminum foil substrate. A phosphor paint is deposited over the barium titanate layer, indium tin oxide electrode is formed over the phosphor paint, and silver busbars are formed all in known manner.

Thereafter, a screenable UV curable desiccant layer comprising a mixture of polyurethane acrylate resins, a cyclic amide, an acrylate ester and a photoinitiator of the type sold by Loctite Corporation under the Trademark "Lite-Tak" type 375 UV Curing Adhesive is applied to the resulting assembly. The manufacturer describes the "Lite-Tak" 375 formulation as follows: The polyurethane acrylate resin mixture in the UV curable adhesive is a mixture of resins sold by Celanese Chemical Co. under the designation Interez CMD-8800. The cyclic amide is N-vinyl pyrrolidone sold by GAF Corp. Chemical Products under the designation V-Pyrol. The acrylate ester is ethoxy ethyl-ethoxy ethyl acrylate sold by Thiokol Chemical Corp. under the designation RC-20 and the photoinitiator is Irgacure 651 sold by Ciba Geigy. This photoinitiator is a substituted acetophenone. The UV curable desiccant layer should be applied to form a cured film of 0.2 to 20 mil; preferably 1 to 2 mil. Curing time directly proportional to film thickness. For example, for a one mil dried thickness of "Lite-Tak" 375, 5 seconds exposure at 365 nanometers, 150,000 microwatts per square centimeter is adequate. For three mils thickness, 10 seconds exposure is desired.

Electrical characteristics of an electroluminescent lamp made in accordance with the foregoing working example were recorded before and after life tests and compared with a conventional, prior art electroluminescent lamp made using a 4 mil thick modified Nylon-6 desiccant film. The results are summarized as follows 1. Brightness degradation measured over time in a 98% relative humidity environment at 40° C. is similar for 4 mil thick modified Nylon-6 and 3 mil thick "Lite-Tak" films.
2. Power and power factor were similar for "Lite-Tak" and modified Nylon-6.
3. Initial brightness was about 10% lower with "Lite-Tak".

As can be seen from the foregoing, the present invention offers a number of significant advantages over the prior art. These include:

1. Dirt and contamination are less of a problem than with a preformed film, since dirt can be filtered out prior to silkscreening; also, there is no problem with static dust;
2. When the lamp assembly process involves lifting the desiccant to place the leads, busbar liftoff can be eliminated, since the desiccant can be patterned leaving exposed areas for the lead contact;
3. Lead attachment can be automated since the prior art step of partially hand-lifting the nylon desiccant film to attach the front lead is eliminated; and
4. The lamp assembly process can be automated much easier because the desiccant layer can be accurately aligned to the lamp, preventing intrusion into the sealed area; also, the placement of the leads is simplified;
5. Dyes can be incorporated into the desiccant layer to create varying colors, eliminating the extra layer, filter, or processing step which is sometimes needed for colorization;
6. The lamp assembly can become an in-line automated process.

Figure 2:
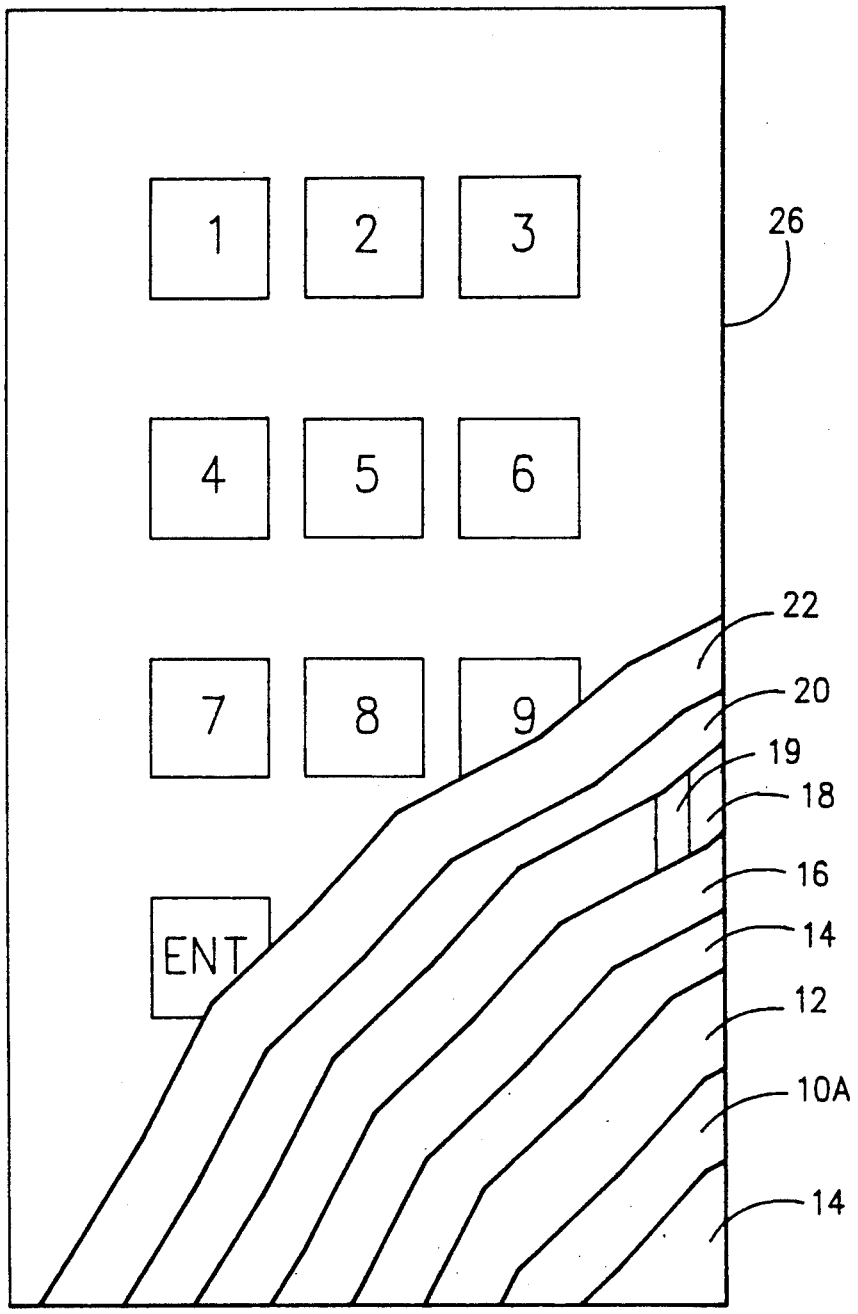
FIG. 2 shows a membrane switch incorporating an electroluminescent lamp made in accordance with the present invention.

While the above embodiments are shown to provide a preferred embodiment of the invention, modifications thereof may be made within the spirit and scope of the invention. For example, as shown in FIG. 2, the invention also may be advantageously used in the manufacture of thin, highly-flexible lights for use in membrane switch products where it becomes necessary to use other flexible substrates as opposed to the traditionally used rigid aluminum foil. Prior art membrane switch lamps made of soft foil or aluminized polyester typically comprise holes and cut-out areas for the membrane switch. When used with a sheet desiccant, the phosphor and barium titanate coatings have a tendency to delaminate from the soft foil or aluminized polyester when cut. The use of a patternable formed-in-place desiccant polymeric film in place of the traditionally used Nylon desiccant film prevents this from occuring since the cured film coating strengthens the layers. More particularly, as seen in FIG. 2, an electroluminescent lamp is produced following the general procedure detailed for FIG. 1, however, substituting for the 24 oz. aluminum foil sheet 10 10 oz. soft aluminum foil 10A or aluminized polyester. Barium titanate 12 is deposited as before, and a phosphor paint layer 14 deposited over the barium titanate coating 12. An indium tin oxide electrode 16 is screened on as before, and the resulting assembly is coated with a patternable curable desiccant polymer coating 20 in accordance with the teachings of the present invention. The resulting assembly is laminated between ACLAR films 22, 24 and affixed between the switch and graphics layers of the membrane switch. (Further details of the membrane switch panel 26 have been omitted since the switch panel per se forms no part of the present invention.) It should be noted that typical membrane switch lamps inherently have a low life since they use thin materials and no desiccant layer to increase the tactility (in order to minimize actuation force). The membrane switch lamp in this invention uses a desiccant layer which increases the life of the lamp.

Still other changes may be made in the invention without departing from the spirit and scope thereof.

We claim:

1. An improved electroluminescent lamp assembly comprising (a) an electroluminescent lamp comprising, in order, a base electrode layer, an electroluminescent phosphor layer, a transparent or translucent electrode layer and a busbar in contact with said transparent or translucent electrode layer and (b) a moisture barrier encasing said electroluminescent lamp (a), wherein the improvement comprises the presence of at least one desiccant layer in said electroluminescent lamp (a), said desiccant layer comprising a cured, patterned, hygroscopic film which has been prepared by applying a liquid film of a curable film-forming hygroscopic coating material, in a pattern, to at least one of the other layers in said electroluminescent lamp (a) and thereafter curing the same in-situ.

2. The improved electroluminescent lamp of claim 1 wherein at least one desiccant layer is adjacent said base electrode layer, opposite said electroluminescent phosphor layer.

3. The improved electroluminescent lamp of claim 1 wherein the desiccant layer is transparent or translucent in its cured state.

4. The improved electroluminescent lamp of claim 3 where the at least one desiccant layer is adjacent the phosphor layer or the transparent electrode layer or both.

5. The improved electroluminescent lamp of claim 1 further comprising an insulating layer between said base electrode layer and said electroluminescent phosphor layer.

6. The improved electroluminescent lamp of claim 5 wherein the insulating layer comprises barium titanate.

7. The improved electroluminescent lamp of claim 1 wherein the electroluminescent phosphor layer comprises an insulating material having the phosphor dispersed therein.

8. The improved electroluminescent lamp of claim 1 wherein said liquid, curable, hygroscopic coating material comprises any one of the following:

(a) a film forming polymer solution, (b) a film forming polymer emulsion, or (c) a film forming curable composition.

9. The improved electroluminescent lamp of claim 1 wherein the desiccant layer comprises a photocured polyurethane acrylate resin.

10. The improved electroluminescent lamp of claim 1 wherein said desiccant layer further comprises a dye.

11. The improved electroluminescent lamp of claim 8 wherein said desiccant layer further comprises a dye.

12. The improved electroluminescent lamp of claim 9, wherein said desiccant layer further comprises a dye.

13. An improved method for manufacturing electroluminescent lamp assemblies, said method comprising manufacturing an electroluminescent lamp and thereafter encasing said electroluminescent lamp in a moisture barrier wherein the electroluminescent lamp itself is manufactured by the method comprising the steps of preparing, in order, a based electrode layer, an electroluminescent phosphor layer, a transparent or translucent electrode layer and a busbar in contact with said transparent or translucent electrode layer, wherein the improvement comprises the additional steps of applying a coating of a liquid, curable, patternable film-forming hygroscopic coating material to at least one of said other layers of said electroluminescent lamp and thereafter curing said coating material, in-situ, so as to create a desiccant film layer in said electroluminescent lamp.

14. The improved method of claim 13 wherein said film-forming hygroscopic material is cured by any one of solvent evaporation, photocuring, heat curing, air drying, oven drying, and radiation curing as appropriate for the selected film-forming material.

15. The improved method of claim 13 wherein during the manufacture of said electroluminescent lamp, said base electrode layer is first formed on a first layer of a moisture-proof film which is adjoined to a second layer of a moisture-proof film applied atop the completed electroluminescent lamp opposite said first moisture-proof film layer so as to encase said electroluminescent lamp in the final step of its manufacture.

16. The improved method of claim 13 wherein the coating material is applied to the surface of the base electrode layer opposite said electroluminescent phosphor layer.

17. The method according to claim 13 wherein the hygroscopic coating material is transparent or translucent in its cured state and is applied to the transparent or translucent electrode layer opposite the electroluminescent phosphor layer.

* * * * *